US009984620B2

(12) United States Patent
Lee

(10) Patent No.: US 9,984,620 B2
(45) Date of Patent: May 29, 2018

(54) CURRENT SENSING CIRCUIT AND ORGANIC LIGHT EMITTING DISPLAY DEVICE INCLUDING THE SAME

(71) Applicant: SAMSUNG DISPLAY CO., LTD., Yongin-si, Gyeonggi-do (KR)

(72) Inventor: Giljae Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 43 days.

(21) Appl. No.: 14/986,602

(22) Filed: Dec. 31, 2015

(65) Prior Publication Data

US 2016/0225314 A1 Aug. 4, 2016

(30) Foreign Application Priority Data

Feb. 4, 2015 (KR) ..... 10-2015-0017432

(51) Int. Cl.
*G09G 3/32* (2016.01)
*G09G 3/00* (2006.01)
*G09G 3/3233* (2016.01)

(52) U.S. Cl.
CPC ..... *G09G 3/3233* (2013.01); *G09G 3/006* (2013.01); *G09G 2320/0233* (2013.01); *G09G 2320/0295* (2013.01); *G09G 2320/045* (2013.01); *G09G 2330/12* (2013.01)

(58) Field of Classification Search
CPC ..... G09G 3/3233; G09G 3/3406; G09G 2320/0233; G09G 2320/045; G09G 2320/043; G09G 2320/0295; G09G 2300/0819; G09G 2310/0297; G09G 2320/029; G09G 2330/12; H01L 27/3244; H01L 27/3276; H01L 27/3279
See application file for complete search history.

(56) References Cited

U.S. PATENT DOCUMENTS 5,621,406 A * 4/1997 Goetzinger ..... H03M 1/1009 341/118
6,476,677 B1 11/2002 Komaili et al.
9,171,504 B2 * 10/2015 Azizi ..... G09G 3/006
9,430,968 B2 * 8/2016 Kishi ..... G09G 3/3233
2004/0222845 A1 11/2004 Yang et al.
2009/0184903 A1 * 7/2009 Kwon ..... G09G 3/3225 345/80
2014/0056089 A1 2/2014 Vimercati
2014/0198092 A1 * 7/2014 Azizi ..... G09G 3/006 345/212

(Continued)

FOREIGN PATENT DOCUMENTS

JP 2003-152543 A 5/2003
JP 2005-64001 A 3/2005
JP 2009-88774 A 4/2009

(Continued)

*Primary Examiner* — Xuemei Zheng
(74) *Attorney, Agent, or Firm* — Lewis Roca Rothgerber Christie LLP

(57) ABSTRACT

A current sensing circuit includes a first integrator configured to receive a first input current and to output a first integration signal, a second integrator configured to receive a second input current and to output a second integration signal, and a current controller configured to control at least one of the first input current and the second input current in response to the second integration signal.

15 Claims, 11 Drawing Sheets

(56) References Cited

U.S. PATENT DOCUMENTS

2016/0111044 A1* 4/2016 Kishi ..... G09G 3/3233
345/690

FOREIGN PATENT DOCUMENTS

| | | | |
|---|---|---|---|
| KR | 2003-0041983 | A | 5/2003 |
| KR | 10-2004-0096719 | A | 11/2004 |
| KR | 10-2008-0002226 | A | 1/2008 |

* cited by examiner

CURRENT SENSING CIRCUIT AND ORGANIC LIGHT EMITTING DISPLAY DEVICE INCLUDING THE SAME

CROSS-REFERENCE TO RELATED APPLICATION

This application claims priority to and the benefit of Korean Patent Application No. 10-2015-0017432, filed on Feb. 4, 2015, in the Korean Intellectual Property Office, the entire content of which is incorporated herein by reference in its entirety.

BACKGROUND

1. Field

Aspects of embodiments of the present invention relate to a current sensing circuit and an organic light emitting display device including the same.

2. Description of the Related Art

In recent years, various types (kinds) of display devices having reduced weight and volume in comparison to a cathode ray tube have been developed. Examples of the display devices may include a liquid crystal display device, a field emission display device, a plasma display device, and an organic light emitting display device.

Among these display devices, the organic light emitting display device displays images using an organic light emitting diode that generates light by recombination of electrons and holes. The organic light emitting display device has a high response speed and displays a clear image.

SUMMARY

Aspects of embodiments of the present invention are directed toward a current sensing circuit and an organic light emitting display device including the same.

According to an embodiment of the present invention, there is provided a current sensing circuit, including: a first integrator configured to receive a first input current and to output a first integration signal; a second integrator configured to receive a second input current and to output a second integration signal; and a current controller configured to control at least one of the first input current and the second input current in response to the second integration signal.

In an embodiment, the current sensing circuit further includes an output unit configured to receive the first integration signal and the second integration signal, and to output a signal corresponding to a difference between the first integration signal and the second integration signal.

In an embodiment, the current sensing circuit further includes: a first variable current source coupled to an input terminal of the first integrator; and a second variable current source coupled to an input terminal of the second integrator.

In an embodiment, the current controller is further configured to control an output current of the first variable current source and an output current of the second variable current source.

In an embodiment, the output current of the first variable current source and the output current of the second variable current source are substantially the same.

In an embodiment, the current controller is further configured to compare a value of the second integration signal with a reference value, and to increase the output current of the first variable current source and the output current of the second variable current source when the value of the second integration signal is greater than the reference value.

In an embodiment, the first input current decreases as the output current of the first variable current source increases, and wherein the second input current decreases as the output current of the second variable current source increases.

According to an embodiment of the present invention, there is provided an organic light emitting display device, including: a plurality of pixels coupled to a plurality of scan lines and a plurality of data lines; and a current sensing circuit configured to receive a first sensing current and a second sensing current output from two of the data lines, wherein the current sensing circuit includes: a first terminal configured to receive the first sensing current; a second terminal configured to receive the second sensing current; a first integrator having an input terminal coupled to the first terminal, the first integrator being configured to receive a first input current and to output a first integration signal; a second integrator having an input terminal coupled to the second terminal, the second integrator being configured to receive a second input current and to output a second integration signal; and a current controller configured to control at least one of the first input current and the second input current in response to the second integration signal.

In an embodiment, the current sensing circuit further includes an output unit configured to receive the first integration signal and the second integration signal, and to output a signal corresponding to a difference between the first integration signal and the second integration signal.

In an embodiment, the current sensing circuit further includes a first variable current source coupled to the input terminal of the first integrator, and a second variable current source coupled to the input terminal of the second integrator.

In an embodiment, the current controller is further configured to control an output current of the first variable current source and an output current of the second variable current source.

In an embodiment, the output current of the first variable current source and the output current of the second variable current source are substantially the same.

In an embodiment, the current controller is further configured to compare a value of the second integration signal with a reference value, and to increase the output current of the first variable current source and the output current of the second variable current source when the value of the second integration signal is greater than the reference value.

In an embodiment, the first input current decreases as the output current of the first variable current source increases, and the second input current decreases as the output current of the second variable current source increases.

In an embodiment, the organic light emitting display device further includes a multiplexer coupled to the data lines, wherein the multiplexer is configured to select the two of the data lines and to electrically connect the two of the data lines to the first terminal and the second terminal, respectively.

In an embodiment, each of the pixels includes: an organic light emitting diode; a pixel circuit between a scan line, a data line, and an anode electrode of the organic light emitting diode, and is configured to control a current supplied to the organic light emitting diode; and a sensing switch coupled between the anode electrode of the organic light emitting diode and the data line.

In an embodiment, the pixel circuit includes: a driving transistor coupled between a driving voltage supply and the anode electrode of the organic light emitting diode and having a gate electrode coupled to a first node; a scan transistor coupled between the data line and the first node and having a gate electrode coupled to the scan line; and a storage capacitor coupled between the driving voltage supply and the first node.

In an embodiment, the pixel circuit further includes a control transistor coupled between the driving transistor and the organic light emitting diode.

In an embodiment, the data lines include a first sensing data line electrically coupled to the first terminal of the current sensing circuit and a second sensing data line electrically coupled to the second terminal of the current sensing circuit by the multiplexer, wherein at least one of sensing switches coupled to the first sensing data line is turned on, and wherein all the sensing switches coupled to the second sensing data line are turned off.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout.

DETAILED DESCRIPTION

Hereinafter, various examples of embodiments will be described in detail with reference to the accompanying drawings.

Figure 1:
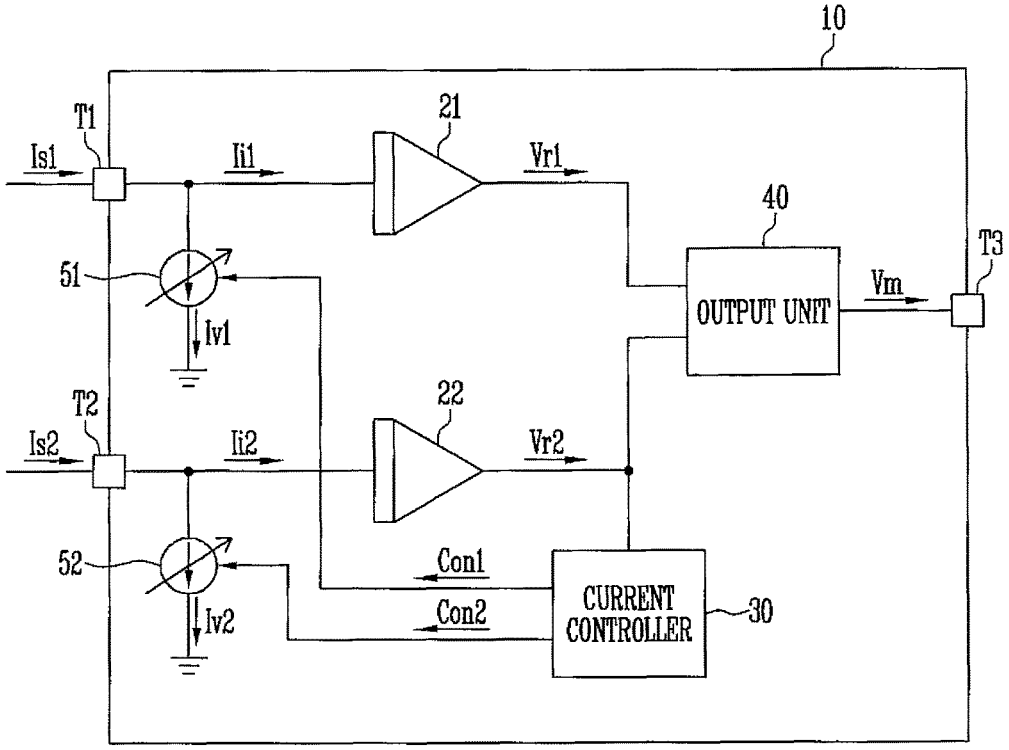
FIG. 1 is a diagram illustrating a current sensing circuit according to an embodiment of the present invention.
Figure 2:
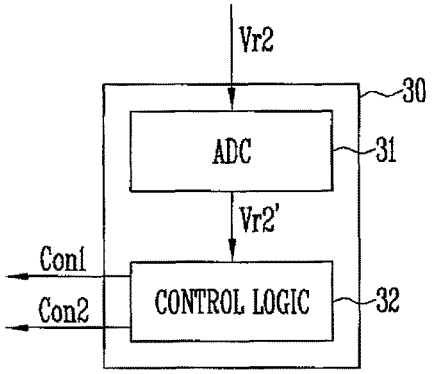
FIG. 2 is a diagram illustrating a current controller according to an embodiment of the present invention.

FIG. 1 is a diagram illustrating a current sensing circuit according to an embodiment of the present invention. FIG. 2 is a diagram illustrating a current controller according to an embodiment of the present invention.

Referring to FIG. 1, a current sensing circuit 10 may include a first terminal T1, a second terminal T2, and a third terminal T3.

A first sensing current Is1 and a second sensing current Is2 to be measured may be input to the first terminal T1 and the second terminal T2, respectively.

An output signal Vm, which is output from an output unit 40, may be output through the third terminal T3.

The current sensing circuit 10 may include a first integrator 21, a second integrator 22, a current controller 30, the output unit 40, a first variable current source 51, and a second variable current source 52.

The first integrator 21 may receive a first input current Ii1 and output a first integration signal Vr1.

The first input current Ii1 may have a value smaller than or equal to that of the first sensing current Is1.

In addition, an input terminal of the first integrator 21 may be coupled to the first terminal T1, and an output terminal of the first integrator 21 may be coupled to the output unit 40.

Thus, the first integrator 21 may supply the first integration signal Vr1 to the output unit 40.

The first integration signal Vr1 output from the first integrator 21 may correspond to an integral value of the first input current Ii1, as shown in the following equation:

$$Vr1=A\times\int Ii1(t)dt$$

where A is a constant.

The second integrator 22 may receive a second input current Ii2 and output a second integration signal Vr2.

The second input current Ii2 may have a value lower than or equal to that of the second sensing current Is2.

In addition, an input terminal of the second integrator 22 may be coupled to the second terminal T2, and an output terminal of the second integrator 22 may be coupled to the output unit 40.

Therefore, the second integrator 22 may supply the second integration signal Vr2 to the output unit 40.

The second integration signal Vr2 output from the second integrator 22 may correspond to an integral value of the second input current Ii2 as shown in the following equation:

$$Vr2=A\times\int Ii2(t)dt$$

where A is a constant.

The current controller 30 may control at least one of the first input current Ii1 and the second input current Ii2 in response to the second integration signal Vr2 output from the second integrator 22.

To control at least one of the first input current Ii1 and the second input current Ii2, the current controller 30 may receive the second integration signal Vr2 from the second integrator 22.

For example, the current controller 30 may compare a value of the second integration signal Vr2 with a preset or predetermined reference value, and reduce the first input current Ii1 and the second input current Ii2 when the value of the second integration signal Vr2 is greater than the reference value.

As a result, saturation of the first integrator 21 and the second integrator 22 may be reduced or prevented, and the values of the first and second integration signals Vr1 and Vr2 may be accurately calculated.

In addition, when the value of the second integration signal Vr2 is less than the reference value, the current controller 30 may maintain the first input current Ii1 and the second input current Ii2.

To control the value of the first input current Ii1 input to the first integrator 21, the first variable current source 51 may be coupled to the input terminal of the first integrator 21.

Therefore, as an output current Iv1 of the first variable current source 51 increases, the first input current Ii1 may decrease.

In other words, the first sensing current Is1 may represent the sum of the output current Iv1 of the first variable current source 51 and the first input current Ii1. Therefore, as the output current Iv1 of the first variable current source 51 increases, the first input current Ii1 may decrease, and as the output current Iv1 of the first variable current source 51 decreases, the first input current Ii1 may increase.

For example, when the output current Iv1 of the first variable current source 51 is set to zero, the first input current Ii1 may have a value equal to that of the first sensing current Is1.

In addition, when the output current Iv1 of the first variable current source 51 is set to be equal to the first sensing current Is1, the first input current Ii1 may be set to zero.

For example, to reduce the first input current Ii1 to an appropriate value, the output current Iv1 of the first variable current source 51 may be greater than zero and smaller than the first sensing current Is1.

To control the value of the second input current Ii2 input to the second integrator 22, the second variable current source 52 may be coupled to the input terminal of the second integrator 22.

Therefore, as the output current Iv2 of the second variable current source 52 increases, the second input current Ii2 may decrease.

In other words, the second sensing current Is2 may represent the sum of the output current Iv2 of the second variable current source 52 and the second input current Ii2. As the output current Iv2 of the second variable current source 52 increases, the second input current Ii2 may decrease, and as the output current Iv2 of the second variable current source 52 decreases, the second input current Ii2 may increase.

For example, when the output current Iv2 of the second variable current source 52 is set to zero, the second input current Ii2 may have a value equal to the second sensing current Is2.

In addition, the output current Iv2 of the second variable current source 52 is set to be equal to the second sensing current Is2, the second input current Ii2 may be set to zero.

For example, to reduce the second input current Ii2 to an appropriate value, the output current Iv2 of the second variable current source 52 may be set to be greater than zero and lower than the second sensing current Is2.

The current controller 30 may control the output current Iv1 of the first variable current source 51 and the output current Iv2 of the second variable current source 52.

For example, the current controller 30 may control the output current Iv1 of the first variable current source 51 by supplying a first control signal Con1 to the first variable current source 51.

In addition, the current controller 30 may control the output current Iv2 of the second variable current source 52 by supplying a second control signal Con2 to the second variable current source 52.

For example, the current controller 30 may control the output current Iv1 of the first variable current source 51 and the output current Iv2 of the second variable current source 52 to have the same or substantially the same value as each other.

When input currents Ii1 and Ii2 are greater than expected, outputs of the integrators 21 and 22 may be saturated.

To reduce or prevent the saturation of the integrators 21 and 22, the current controller 30 may compare the value of the second integration signal Vr2 with the preset or predetermined reference value, and increase the output current Iv1 of the first variable current source 51 and the output current Iv2 of the second variable current source 52 when the value of the second integration signal Vr2 is greater than the reference value.

In addition, the current controller 30 may compare the value of the second integration signal Vr2 with the preset or predetermined reference value, and maintain or reduce the output current Iv1 of the first variable current source 51 and the output current Iv2 of the second variable current source 52 when the value of the second integration signal Vr2 is less than the reference value.

Referring to FIG. 2, the current controller 30 may include an analog-to-digital converter 31 and a control logic 32.

The analog-to-digital converter 31 may receive a second integration signal Vr2 from the second integrator 22 and generate a digital signal Vr2' corresponding to the second integration signal Vr2.

The control logic 32 may receive the digital signal Vr2' from the analog-to-digital converter 31, compare a value of the digital signal Vr2' with the preset or predetermined reference value, and generate the first control signal Con1 and the second control signal Con2 reflecting a comparison result.

As described above, when the value of the digital signal Vr2' is greater than the preset or predetermined reference value, the control logic 32 may increase the output current Iv1 of the first variable current source 51 and the output current Iv2 of the second variable current source 52.

In addition, when the value of the digital signal Vr2' is less than the preset or predetermined reference value, the control logic 32 may maintain or reduce the output current Iv1 of the first variable current source 51 and the output current Iv2 of the second variable current source 52.

The output unit 40 may function to perform correlated double sampling (CDS).

To perform CDS, the output unit 40 may receive the first integration signal Vr1 and the second integration signal Vr2 from the first integrator 21 and the second integrator 22, respectively.

In addition, the output unit 40 may generate the output signal Vm corresponding to a difference between the first integration signal Vr1 and the second integration signal Vr2, and output the generated output signal Vm to the third terminal T3.

Figure 3:
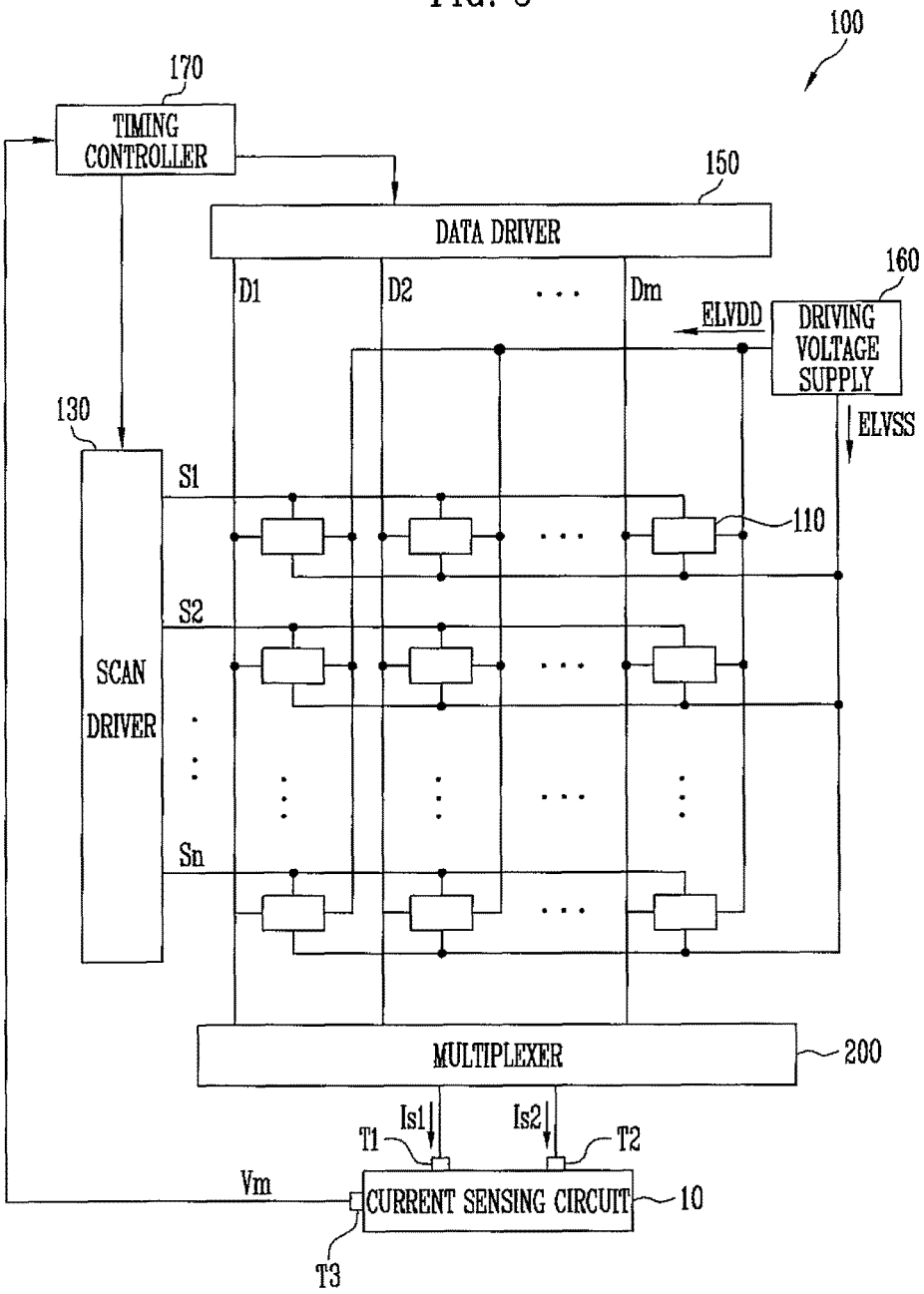
FIG. 3 is a diagram illustrating an organic light emitting display device according to an embodiment of the present invention.
Figure 4:
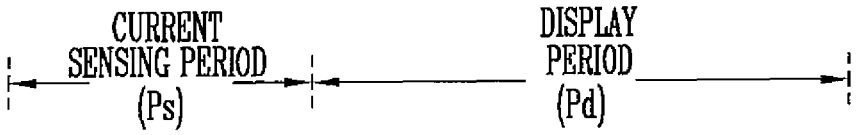
FIG. 4 is a diagram showing a current sensing period and a display period according to an embodiment of the present invention.

FIG. 3 is a diagram illustrating an organic light emitting display device according to an embodiment of the present invention. FIG. 4 is a diagram showing a current sensing period and a display period according to an embodiment of the present invention.

Referring to FIG. 3, an organic light emitting display device 100 may include the current sensing circuit 10, a plurality of pixels 110, a scan driver 130, a data driver 150, a driving voltage supply 160, a timing controller 170 and a multiplexer 200.

The plurality of pixels 110 may be coupled to a plurality of scan lines S1 to Sn and a plurality of data lines D1 to Dm. For example, the pixels 110 may be arranged in an n×m matrix.

In addition, each of the pixels 110 which receives a first driving voltage ELVDD and a second driving voltage ELVSS from the driving voltage supply 160 may generate light in response to a data signal by a current flowing from the first driving voltage ELVDD to the second driving voltage ELVSS via an organic light emitting diode.

For example, the pixels 110 may display an image (e.g., a predetermined image) by performing a light emitting operation during a display period Pd.

In addition, the pixels 110 may maintain a non-emission state during a current sensing period Ps.

The scan driver 130 may generate a scan signal in response to control of the timing controller 170 and supply the generated scan signal to the scan lines S1 to Sn.

For example, the scan driver 130 may supply a scan signal to the pixels 110 through the scan lines S1 to Sn during the display period Pd so that the data signal may be written to the corresponding pixel.

In addition, the scan driver 130 may not supply the scan signal during the current sensing period Ps.

The data driver 150 may generate a data signal in response to control of the timing controller 170 and supply the generated data signal to the data lines D1 to Dm.

For example, the data driver 150 may generate a data signal in response to an image signal supplied from the timing controller 170 during the display period Pd, and supply the generated data signal to the pixels 110 through the data lines D1 to Dm.

Therefore, each of the pixels 110 may emit light with a brightness corresponding to the data signal during the display period Pd.

The data driver 150 may supply an auxiliary voltage (Va in FIG. 6) to at least some of the data lines D1 to Dm during the current sensing period Ps.

The driving voltage supply 160 may supply the first driving voltage ELVDD and the second driving voltage ELVSS to the pixels 110.

For example, the driving voltage supply 160 may convert an externally supplied voltage into the first driving voltage ELVDD and the second driving voltage ELVSS.

The driving voltage supply 160 may include a plurality of DC-DC converters.

The driving voltage supply 160 may change the first driving voltage ELVDD and the second driving voltage ELVSS.

For example, the driving voltage supply 160 may set the first driving voltage ELVDD to a first voltage V1 having a positive polarity and the second driving voltage ELVSS to a second voltage V2 having a negative polarity, during the display period Pd.

However, the driving voltage supply 160 may set the first driving voltage ELVDD to the second voltage V2 having the negative polarity and the second driving voltage ELVSS to the first voltage V1 having the positive polarity, during the current sensing period Ps.

For example, when the current sensing period Ps starts, the driving voltage supply 160 may set each of the first driving voltage ELVDD and the second driving voltage ELVSS to the second voltage V2.

Subsequently, when the display period Pd starts, the driving voltage supply 160 may change the first driving voltage ELVDD to the first voltage V1 and maintain the second driving voltage ELVSS at the second voltage V2.

In another example, the driving voltage supply 160 may set the first driving voltage ELVDD and the second driving voltage ELVSS to the first voltage V1 during the current sensing period Ps.

Subsequently, when the display period Pd starts, the driving voltage supply 160 may change the second driving voltage ELVSS to the second voltage V2 and maintain the first driving voltage ELVDD at the first voltage V1.

The timing controller 170 may control the scan driver 130 and the data driver 150.

For example, the timing controller 170 may receive a control signal from an external device and generate a signal for controlling the scan driver 130 and the data driver 150 by using the control signal.

In addition, the timing controller 170 may receive an image signal from an external device, convert the image signal according to specifications of the data driver 150, and supply the converted image signal to the data driver 150.

For example, the timing controller 170 may receive the output signal Vm from the current sensing circuit 10.

To compensate for deterioration of the pixels 110, the timing controller 170 may compensate for the image signal by reflecting the output signal Vm.

The multiplexer 200 may be coupled to the data lines D1 to Dm. In addition, the multiplexer 200 may select two of the data lines D1 to Dm and electrically connect the two selected data lines to the first terminal T1 and the second terminal T2 of the current sensing circuit 10, respectively.

For example, the multiplexer 200 may electrically connect the two selected data lines to the first terminal T1 and the second terminal T2 of the current sensing circuit 10 during the current sensing period Ps.

In addition, the multiplexer 200 may block an electrical connection between the data lines D1 to Dm and the current sensing circuit 10 during the display period Pd.

The current sensing circuit 10 may be coupled to the multiplexer 200. For example, the current sensing circuit 10 may include the first terminal T1 and the second terminal T2 coupled to the multiplexer 200.

In addition, the current sensing circuit 10 may be electrically coupled to the two data lines selected by the multiplexer 200 through the first terminal T1 and the second terminal T2, respectively.

Therefore, the current sensing circuit 10 may receive the first sensing current Is1 and the second sensing current Is2 from the two data lines, respectively.

The current sensing circuit 10 may receive the first sensing current Is1 and the second sensing current Is2 to generate the final output signal Vm.

In addition, the current sensing circuit 10 may supply the generated output signal Vm to the timing controller 170 through the third terminal T3.

The detailed configuration and operation of the current sensing circuit 10 are described in detail with reference to FIGS. 1 and 2. Thus, a detailed description thereof may not be provided.

Figure 5:
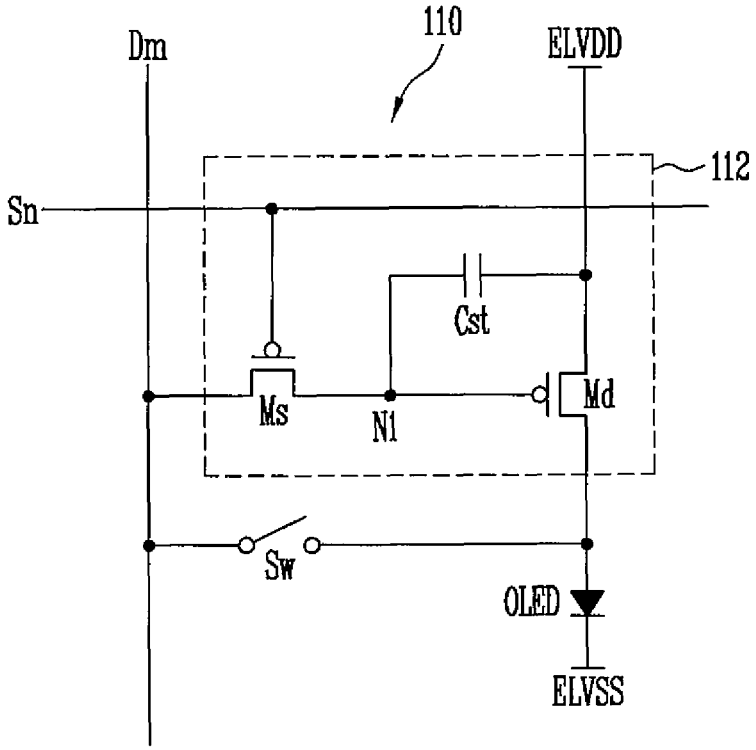
FIG. 5 is a diagram illustrating an embodiment of one of pixels shown in FIG. 3.

FIG. 5 is a diagram illustrating an embodiment of one of the pixels shown in FIG. 3. In FIG. 5, the pixel is coupled to an $n^{th}$ scan line Sn and an $m^{th}$ data line Dm for convenience of explanation.

Referring to FIG. 5, the pixel 110 may include an organic light emitting diode OLED, a pixel circuit 112, and a sensing switch Sw.

An anode electrode of the organic light emitting diode OLED may be coupled to the pixel circuit 112, and a cathode electrode thereof may be coupled to the second driving voltage ELVSS.

The above-described organic light emitting diode OLED may generate light with a brightness (e.g., a predetermined brightness) by a current supplied from the pixel circuit 112.

The pixel circuit 112 may be located between the data line Dm, the scan line Sn, and the anode electrode of the organic light emitting diode OLED. The pixel circuit may control a current being supplied to the organic light emitting diode OLED.

For example, the pixel circuit 112 may control the amount of current being supplied to the organic light emitting diode OLED in response to a data signal supplied to the data line Dm, when a scan signal is supplied to the scan line Sn.

To control the amount of current, the pixel circuit 112 may include a driving transistor Md coupled between the first driving voltage ELVDD and the organic light emitting diode OLED; a scan transistor Ms coupled between the driving transistor Md, the data line Dm, and the scan line Sn; and a storage capacitor Cst coupled between a gate electrode and a first electrode of the driving transistor Md.

A gate electrode of the scan transistor Ms may be coupled to the scan line Sn, a first electrode thereof may be coupled to the data line Dm, and a second electrode thereof may be coupled to a first node N1.

The scan transistor Ms coupled to the scan line Sn and the data line Dm may be turned on when the scan signal is supplied from the scan line Sn, and may supply the data signal supplied from the data line Dm to the storage capacitor Cst. The storage capacitor Cst may charge a voltage corresponding to the data signal.

The gate electrode of the driving transistor Md may be coupled to the first node N1, the first electrode thereof may be coupled to the first driving voltage ELVDD, and a second electrode thereof may be coupled to the anode electrode of the organic light emitting diode OLED.

The driving transistor Md may control the amount of current flowing from the first driving voltage ELVDD to the second driving voltage ELVSS through the organic light emitting diode OLED on the basis of a voltage value stored in the storage capacitor Cst.

The storage capacitor Cst may be coupled between the first driving voltage ELVDD and the first node N1.

The organic light emitting diode OLED may generate light corresponding to the amount of current being supplied from the driving transistor Md.

The first driving voltage ELVDD may be maintained at the first voltage V1 having the positive polarity, and the second driving voltage ELVSS may be maintained at the second voltage V2 having the negative polarity so that each of the pixels 110 may normally emit light during the display period Pd.

A first electrode of a transistor may refer to one of a source electrode and a drain electrode, and a second electrode thereof may refer to the other electrode. For example, when the first electrode refers to the source electrode, the second electrode may refer to the drain electrode.

The sensing switch Sw may be coupled between the anode electrode of the organic light emitting diode OLED and the data line Dm.

During the display period Pd, all of the sensing switches Sw may remain turned off, and during the current sensing period Ps, some of the sensing switches Sw may remain turned on.

The pixel structure shown in FIG. 5 is merely an embodiment of the present invention, and the pixel 110 is not limited thereto. The pixel circuit 112 actually has a circuit configuration to supply the current to the organic light emitting diode OLED, and one of various suitable known circuit configurations may be selected therefor.

Figure 6:
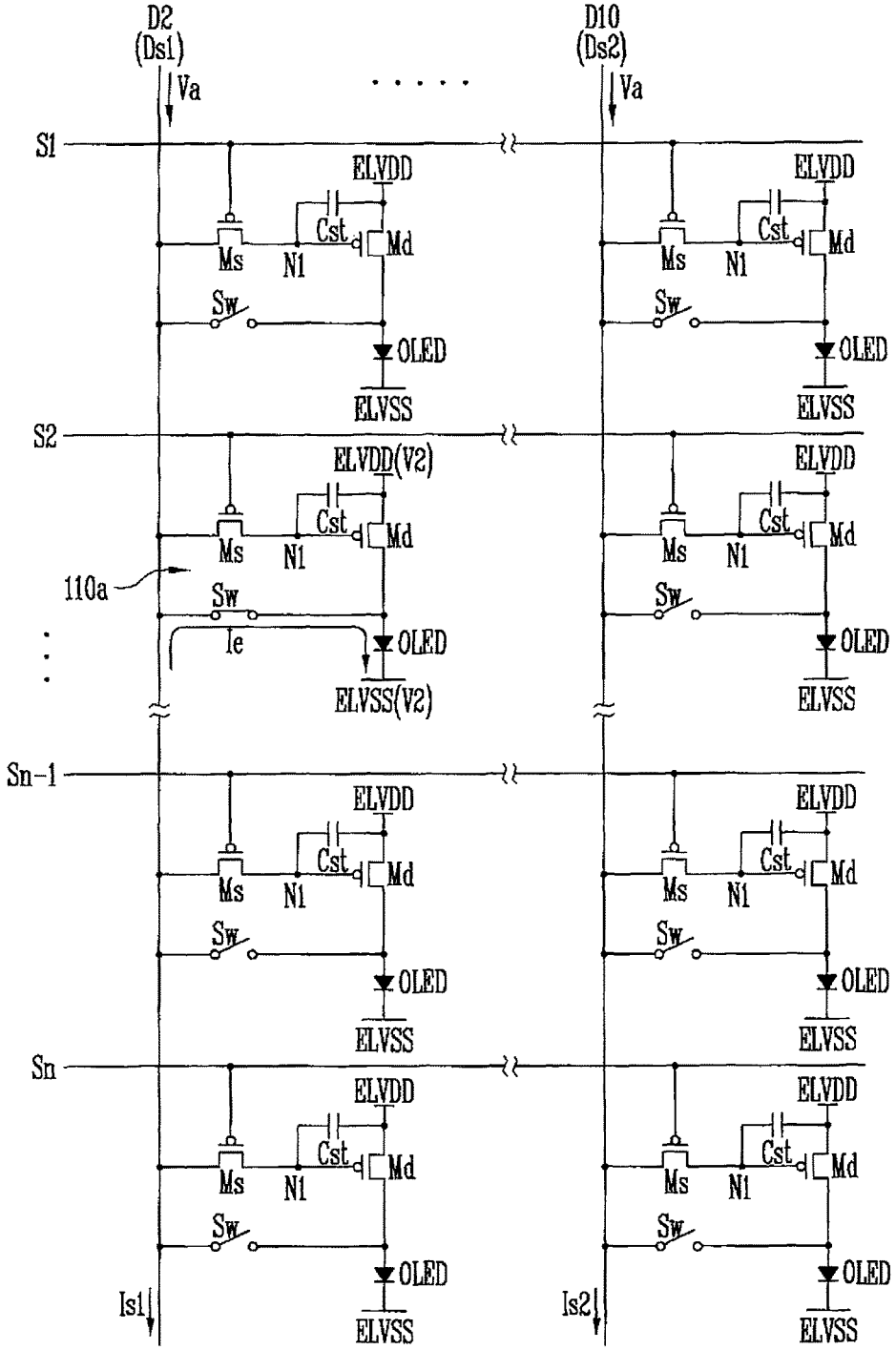
FIG. 6 is a diagram illustrating a current sensing operation according to an embodiment of an organic light emitting device shown in FIG. 3.

FIG. 6 is a diagram illustrating a current sensing operation according to an embodiment of the organic light emitting display device shown in FIG. 3. A case in which a second data line D2 and a tenth data line D10 are selected by the multiplexer 200 during the current sensing period Ps is described with reference to FIG. 6.

Therefore, the second data line D2 and the tenth data line D10 selected by the multiplexer 200 may be electrically connected to the first terminal T1 and the second terminal T2 of the current sensing circuit 10, respectively.

For convenience of explanation, the data line D2 coupled to the first terminal T1 of the current sensing circuit 10 may be referred to as a first sensing data line Ds1.

In addition, the data line D10 coupled to the second terminal T2 of the current sensing circuit 10 may be referred to as a second sensing data line Ds2.

At least one of the sensing switches Sw coupled to the first sensing data line Ds1 may be turned on.

For example, in order to detect a degree of deterioration of a pixel (e.g., predetermined pixel) 110*a* coupled to the second scan lines S2 and the second data line D2, the sensing switch Sw included in the pixel (e.g., the predetermined pixel) 110*a* may be turned on.

The degree of deterioration of the pixel 110*a* may be detected by sensing a current Ie flowing through the organic light emitting diode OLED. Both the first driving voltage ELVDD and the second driving voltage ELVSS may be set to the second voltage V2 having the negative polarity.

In addition, an auxiliary voltage Va may be coupled to the first sensing data line Ds1. The auxiliary voltage Va may be set to a value between the first voltage V1 and the second voltage V2.

Therefore, the current Ie (e.g., a predetermined amount of the current Ie) may flow to the organic light emitting diode OLED included in the pixel (e.g., the predetermined pixel) 110*a* from the first sensing data line Ds1 through the sensing switch Sw.

The first sensing current Is1 flowing from the first sensing data line Ds1 to the first terminal T1 of the current sensing circuit 10 may be expressed as follows:

$$Is1=-Ie.$$

To sense a leakage current of the second sensing data line Ds2, all the sensing switches Sw coupled to the second sensing data line Ds2 may be turned off.

In addition, the same auxiliary voltage Va as that applied to the first sensing data line Ds1 may be supplied to the second sensing data line Ds2.

Because a leakage current flows when all the sensing switches Sw coupled to the second sensing data line Ds2 are turned on, a preset or predetermined amount of the second sensing current Is2 may flow from the second sensing data line Ds2 to the second terminal T2 of the current sensing circuit 10.

Therefore, the above-described current sensing circuit 10 may receive the first sensing current Is1 and the second sensing current Is2.

Subsequently, the current sensing circuit 10 may generate the final output signal Vm by using the first sensing current Is1 and the second sensing current Is2, and supply the generated output signal Vm to the timing controller 170.

Figure 7:
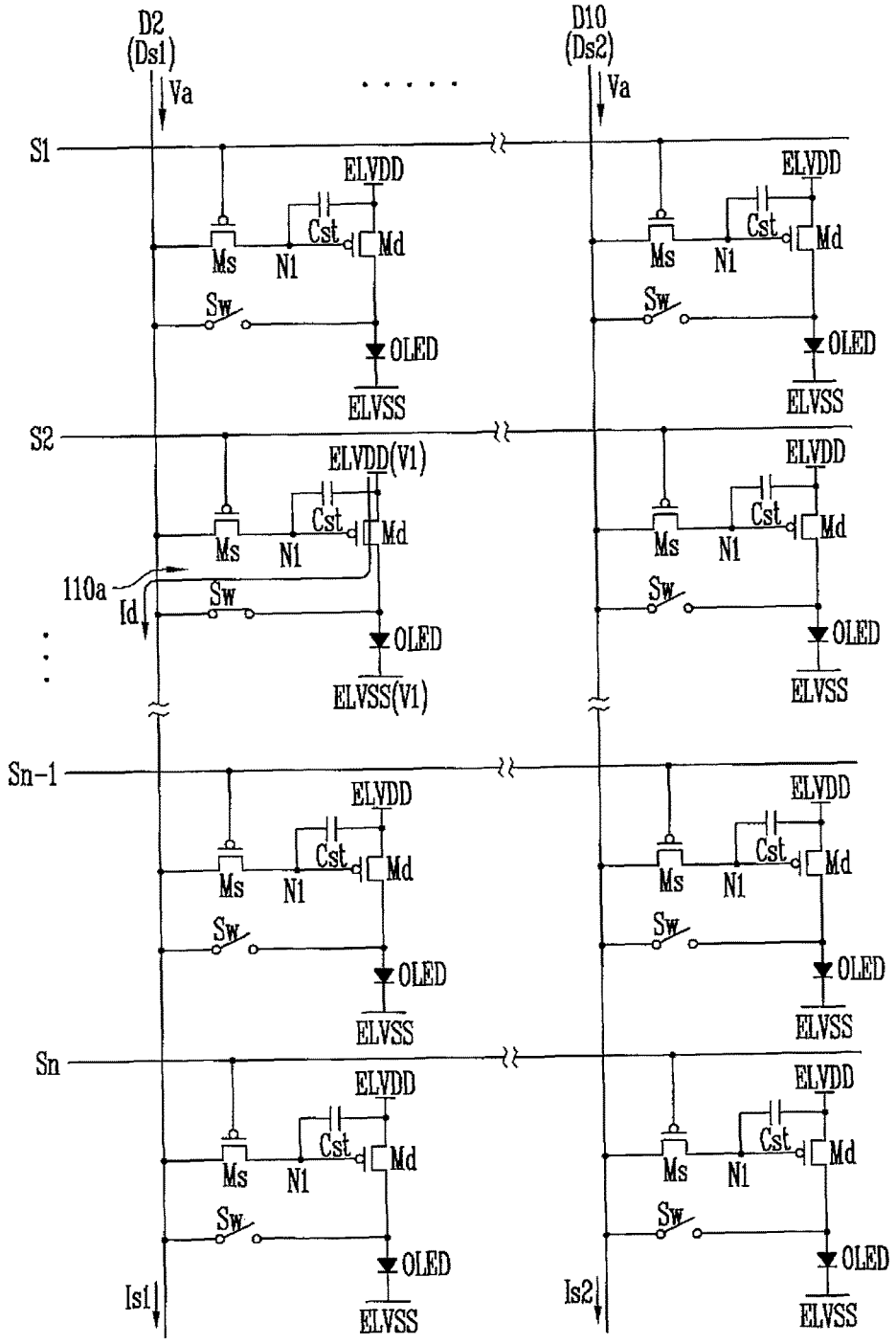
FIG. 7 is a diagram illustrating a current sensing operation according to another embodiment of an organic light emitting device shown in FIG. 3.

FIG. 7 is a diagram illustrating a current sensing operation according to another embodiment of an organic light emitting display device shown in FIG. 3. A case in which the second data line D2 and the tenth data line D10 are selected by the multiplexer 200 during the current sensing period Ps is described with reference to FIG. 7.

Therefore, the second data line D2 and the tenth data line D10 selected by the multiplexer 200 may be electrically connected to the first terminal T1 and the second terminal T2 of the current sensing circuit 10, respectively.

For convenience of explanation, the data line D2 coupled to the first terminal T1 of the current sensing circuit 10 may be referred to as the first sensing data line Ds1.

In addition, the data line D10 coupled to the second terminal T2 of the current sensing circuit 10 may be referred to as the second sensing data line Ds2.

At least one of the sensing switches Sw coupled to the first sensing data line Ds1 may be turned on.

For example, to detect a degree of deterioration of the pixel (e.g., the predetermined pixel) 110*a* coupled to the second scan lines S2 and the second data line D2, the sensing switch Sw included in the pixel (e.g., the predetermined pixel) 110*a* may be turned on.

By sensing a current Id (e.g., a predetermined current Id) flowing through the driving transistor Md, the degree of deterioration of the pixel (e.g., the predetermined pixel) 110*a* may be detected. Both the first driving voltage ELVDD and the second driving voltage ELVSS may be set to the first voltage V1 having the positive polarity.

In addition, the auxiliary voltage Va may be supplied to the first sensing data line Ds1. The auxiliary voltage Va may be set to a value between the first voltage V1 and the second voltage V2.

Therefore, the current Id (e.g., predetermined current Id) may flow through the first sensing data line Ds1 by the driving transistor Md and the sensing switch Sw included in the pixel (e.g., the predetermined pixel) 110*a*.

The first sensing current Is1 flowing from the first sensing data line Ds1 to the first terminal T1 of the current sensing circuit 10 may be expressed as follows:

$$Is1=Id.$$

To sense a leakage current of the second sensing data line Ds2, all the sensing switches Sw coupled to the second sensing data line Ds2 may be turned on.

In addition, the same auxiliary voltage Va as that applied to the first sensing data line Ds1 may be supplied to the second sensing data line Ds2.

Although all the sensing switches Sw coupled to the second sensing data line Ds2 are turned off, a leakage current may still flow. Therefore, an amount of (e.g., a predetermined amount of) the second sensing current Is2 may flow from the second sensing data line Ds2 to the second terminal T2 of the current sensing circuit 10.

Therefore, the above-described current sensing circuit 10 may receive the first sensing current Is1 and the second sensing current Is2.

Subsequently, the current sensing circuit 10 may generate the final output signal Vm by using the first sensing current Is1 and the second sensing current Is2, and supply the generated output signal Vm to the timing controller 170.

Figure 8:
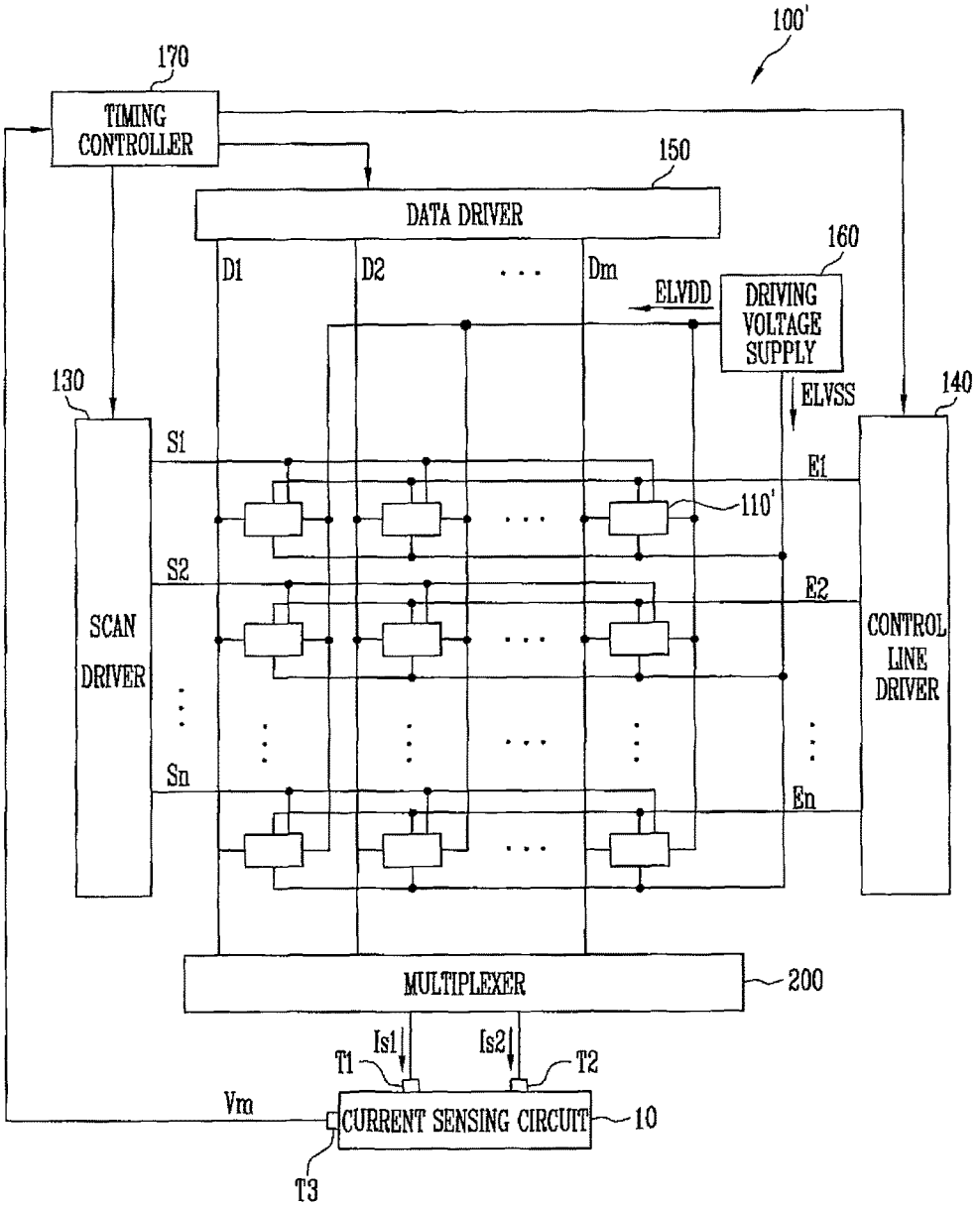
FIG. 8 is a diagram illustrating an organic light emitting display device according to another embodiment of the present invention.

FIG. 8 is a view illustrating an organic light emitting display device according to another embodiment of the present invention.

Referring to FIG. 8, an organic light emitting display device 100' may include the current sensing circuit 10, a plurality of pixels 110', the scan driver 130, a control line driver 140, the data driver 150, the driving voltage supply 160, the timing controller 170, and the multiplexer 200.

The plurality of pixels 110' may be coupled to the plurality of scan lines S1 to Sn, the plurality of data lines D1 to Dm, and a plurality of control lines E1 to En. For example, the pixels 110' may be arranged in an n×m matrix.

In addition, each of the pixels 110' receiving the first driving voltage ELVDD and the second driving voltage ELVSS from the driving voltage supply 160 may generate light in response to a data signal by a current flowing from the first driving voltage ELVDD to the second driving voltage ELVSS through the organic light emitting diode.

For example, the pixels 110' may display an image (e.g., a predetermined image) by performing a light emitting operation during the display period Pd.

In addition, the pixels 110' may maintain a non-emission state during the current sensing period Ps.

The scan driver 130 may generate a scan signal in response to control of the timing controller 170 and supply the generated scan signal to the scan lines S1 to Sn.

For example, the scan driver 130 may supply the scan signal to the pixels 110' through the scan lines S1 to Sn during the display period Pd so that the data signal may be written to the corresponding pixel.

In addition, the scan driver 130 may not supply the scan signal during the current sensing period Ps.

The control line driver 140 may generate an emission control signal in response to control of the timing controller 170 and supply the generated emission control signal to the control lines E1 to En.

For example, the control line driver 140 may cause a driving current corresponding to the data signal to the organic light emitting diode included in each of the pixels 110' by supplying the emission control signal to the control lines E1 to En during the display period Pd.

In addition, the control line driver 140 may not supply the emission control signal during the current sensing period Ps.

In another example, the control line driver 140 may supply the emission control signal to at least one of the pixels 110' during the current sensing period Ps.

The data driver 150 may generate the data signal in response to control of the timing controller 170 and supply the generated data signal to the data lines D1 to Dm.

For example, the data driver 150 may generate a data signal corresponding to an image signal supplied from the timing controller 170 during the display period Pd, and supply the generated data signal to the respective pixels 110' through the data lines D1 to Dm.

Therefore, each of the pixels 110' may emit light with brightness corresponding to the data signal during the display period Pd.

The data driver 150 may supply an auxiliary voltage (e.g., Va in FIG. 10) to at least some of the data lines D1 to Dm during the current sensing period Ps.

The driving voltage supply 160 may supply the first driving voltage ELVDD and the second driving voltage ELVSS to the pixels 110'.

For example, the driving voltage supply 160 may convert an externally supplied voltage into the first driving voltage ELVDD and the second driving voltage ELVSS.

The driving voltage supply 160 may include a plurality of DC-DC converters.

The driving voltage supply 160 may change the first driving voltage ELVDD and the second driving voltage ELVSS.

For example, the driving voltage supply 160 may set the first driving voltage ELVDD to the first voltage V1 having the positive polarity and the second driving voltage ELVSS to the second voltage V2 having the negative polarity, during the display period Pd.

In addition, the driving voltage supply 160 may also set the first driving voltage ELVDD to the first voltage V1 having the positive polarity and the second driving voltage ELVSS to the second voltage V2 having the negative polarity, during the current sensing period Ps.

In another example, the driving voltage supply 160 may set the second driving voltage ELVSS and the first driving voltage ELVDD to the first voltage V1 during the current sensing period Ps.

The timing controller 170 may control the scan driver 130, the control line driver 140 and the data driver 150.

For example, the timing controller 170 may receive a control signal from an external device and generate a signal to control the scan driver 130, the control line driver 140, and the data driver 150 by using the control signal.

In addition, the timing controller 170 may receive an image signal from an external source, convert the image signal according to the specifications of the data driver 150, and supply the converted image signal to the data driver 150.

For example, the timing controller 170 may receive the output signal Vm from the current sensing circuit 10.

To compensate for deterioration of the pixels 110', the timing controller 170 may compensate for the image signal by reflecting the output signal Vm.

The multiplexer 200 may be coupled to the data lines D1 to Dm. In addition, the multiplexer 200 may select two data lines, among the plurality of data lines D1 to Dm, and electrically connect the two selected data lines to the first terminal T1 and the second terminal T2 of the current sensing circuit 10, respectively.

For example, the multiplexer 200 may electrically connect the two selected data lines to the first terminal T1 and the second terminal T2 of the current sensing circuit 10, respectively, during the current sensing period Ps.

In addition, the multiplexer 200 may block an electrical connection between the data lines D1 to Dm and the current sensing circuit 10 during the display period Pd.

The current sensing circuit 10 may be coupled to the multiplexer 200. For example, the current sensing circuit 10 may include the first terminal T1 and the second terminal T2 coupled to the multiplexer 200.

In addition, the current sensing circuit 10 may be electrically connected to the two selected data lines by the multiplexer 200 through the first terminal T1 and the second terminal T2.

The current sensing circuit 10 may receive the first sensing current Is1 and the second sensing current Is2 from the two data lines, respectively.

The current sensing circuit 10 may receive the first sensing current Is1 and the second sensing current Is2 to generate the final output signal Vm.

In addition, the current sensing circuit 10 may supply the generated output signal Vm to the timing controller 170 through the third terminal T3.

The detailed configuration and operation of the current sensing circuit 10 are described above with reference to FIGS. 1 and 2. Thus, a detailed description thereof may not be provided.

Figure 9:
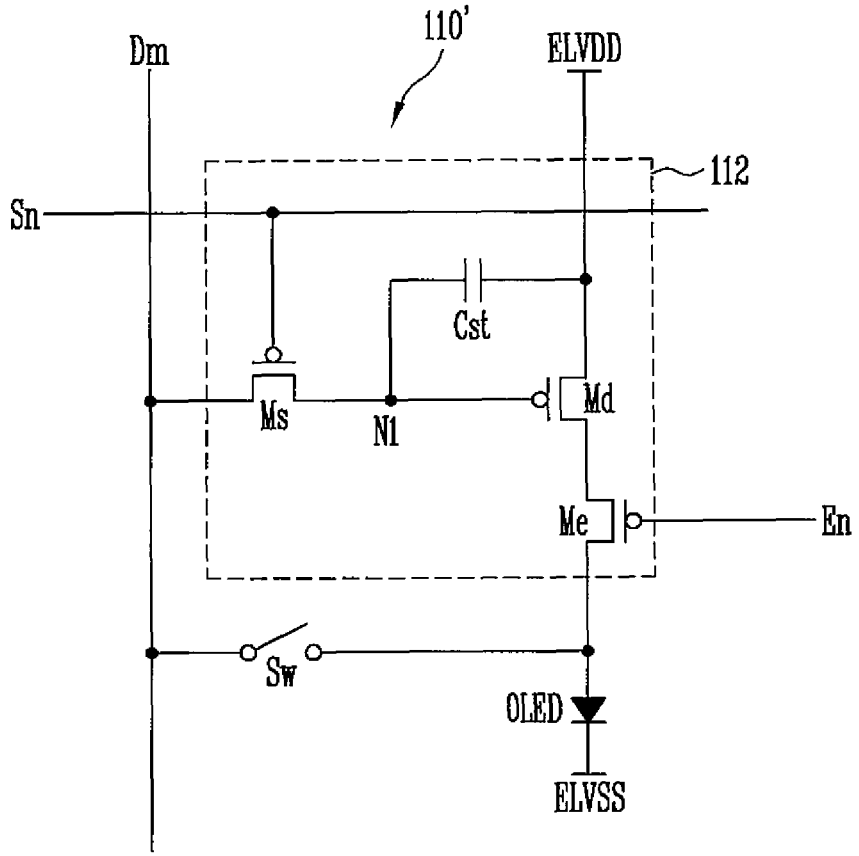
FIG. 9 is a diagram illustrating an embodiment of one of pixels shown in FIG. 8.

FIG. 9 is a diagram illustrating an embodiment of one of the pixels shown in FIG. 8. In FIG. 9, the pixel 110' coupled to the $n^{th}$ scan line Sn, the $m^{th}$ data line Dm and an $n^{th}$ control line En is illustrated for convenience of explanation.

Referring to FIG. 9, each of the pixels 110' may include the organic light emitting diode OLED, the pixel circuit 112 and the sensing switch Sw.

An anode electrode of the organic light emitting diode OLED may be coupled to the pixel circuit 112, and a cathode electrode thereof may be coupled to the second driving voltage ELVSS.

The organic light emitting diode OLED may generate light with a brightness (e.g., a predetermined brightness) in response to the current supplied from the pixel circuit 112.

The pixel circuit 112 may be located between the data line Dm, the scan line Sn, the control line En, and the anode electrode of the organic light emitting diode OLED.

For example, the pixel circuit 112 may control the amount of current being supplied to the organic light emitting diode OLED in response to a data signal supplied to the data line Dm when a scan signal is supplied to the scan line Sn.

The pixel circuit 112 may include the driving transistor Md coupled between the first driving voltage ELVDD and the organic light emitting diode OLED; the scan transistor Ms coupled between the driving transistor Md, the data line Dm, and the scan line Sn; the storage capacitor Cst coupled between the gate electrode and the first electrode of the driving transistor Md; and the control transistor Me coupled between the driving transistor Md and the organic light emitting diode OLED.

The gate electrode of the scan transistor Ms may be coupled to the scan line Sn, the first electrode thereof may be coupled to the data line Dm, and the second electrode thereof may be coupled to the first node N1.

The scan transistor Ms coupled to the scan line Sn and the data line Dm may be turned on when the scan signal is supplied to the scan line Sn, and supply the data signal supplied from the data line Dm to the storage capacitor Cst. The storage capacitor Cst may charge a voltage corresponding to the data signal.

The gate electrode of the driving transistor Md may be coupled to the first node N1, the first electrode thereof may be coupled to the first driving voltage ELVDD, and the second electrode thereof may be coupled to the first electrode of the control transistor Me.

The driving transistor Md may control the amount of current flowing from the first driving voltage ELVDD to the second driving voltage ELVSS through the organic light emitting diode OLED on the basis of a voltage value stored in the storage capacitor Cst.

The storage capacitor Cst may be coupled between the first driving voltage ELVDD and the first node N1.

The gate electrode of the control transistor Me may be coupled to the control line En, the first electrode thereof may be coupled to the second electrode of the driving transistor Md, and the second electrode thereof may be coupled to the anode electrode of the organic light emitting diode OLED.

The control transistor Me may be turned on when an emission control signal is supplied from the control line En, and electrically connect the second electrode of the driving transistor Md and the anode electrode of the organic light emitting diode OLED to each other.

Therefore, when the control transistor Me is turned on, the driving current from the driving transistor Md may be supplied to the organic light emitting diode OLED through the control transistor Me.

The organic light emitting diode OLED may generate light corresponding to the amount of current supplied from the driving transistor Md.

The first driving voltage ELVDD may be maintained at the first voltage V1 having the positive polarity, and the second driving voltage ELVSS may be maintained at the second voltage V2 having the negative polarity so that each of the pixels 110' may normally emit light during the display period Pd.

A first electrode of a transistor may refer to one of a source electrode and a drain electrode, and a second electrode thereof may refer to the other electrode. For example, when the first electrode refers to the source electrode, the second electrode may refer to the drain electrode.

The sensing switch Sw may be coupled between the anode electrode of the organic light emitting diode OLED and the data line Dm.

All of the sensing switches Sw may remain turned off during the display period Pd, and some of the sensing switches Sw may remain turned on during the current sensing period Ps.

The above-described pixel structure shown in FIG. 9 is merely an embodiment of the present invention. Thus, the pixel 110' is not limited to the pixel structure. The pixel circuit 112 actually has a circuit configuration to supply the current to the organic light emitting diode OLED, and any one of known various suitable structures may be selected therefor.

Figure 10:
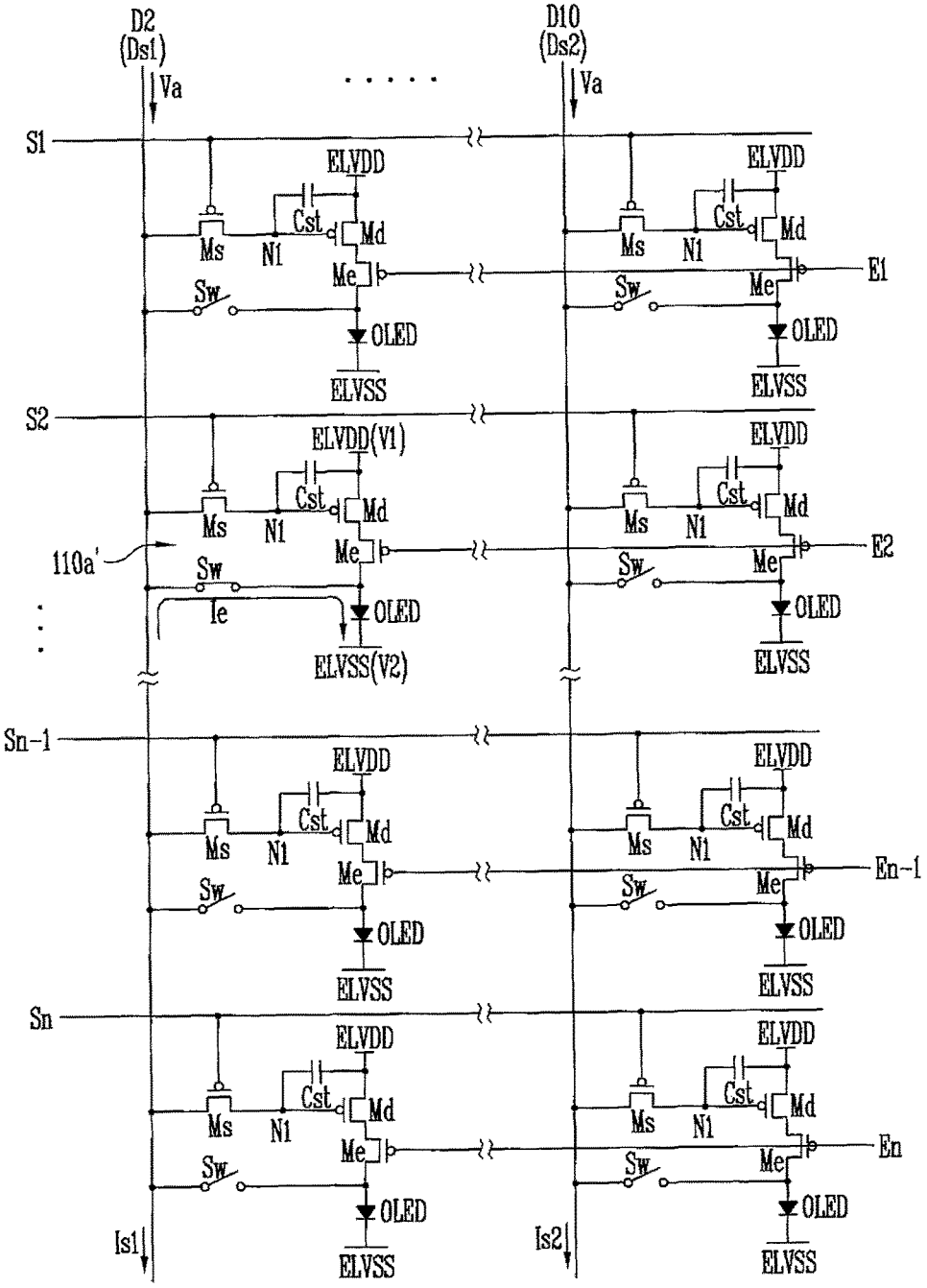
FIGS. 10-11 are diagrams illustrating a current sensing operation according to an embodiment of an organic light emitting display device shown in FIG. 8.
Figure 11:
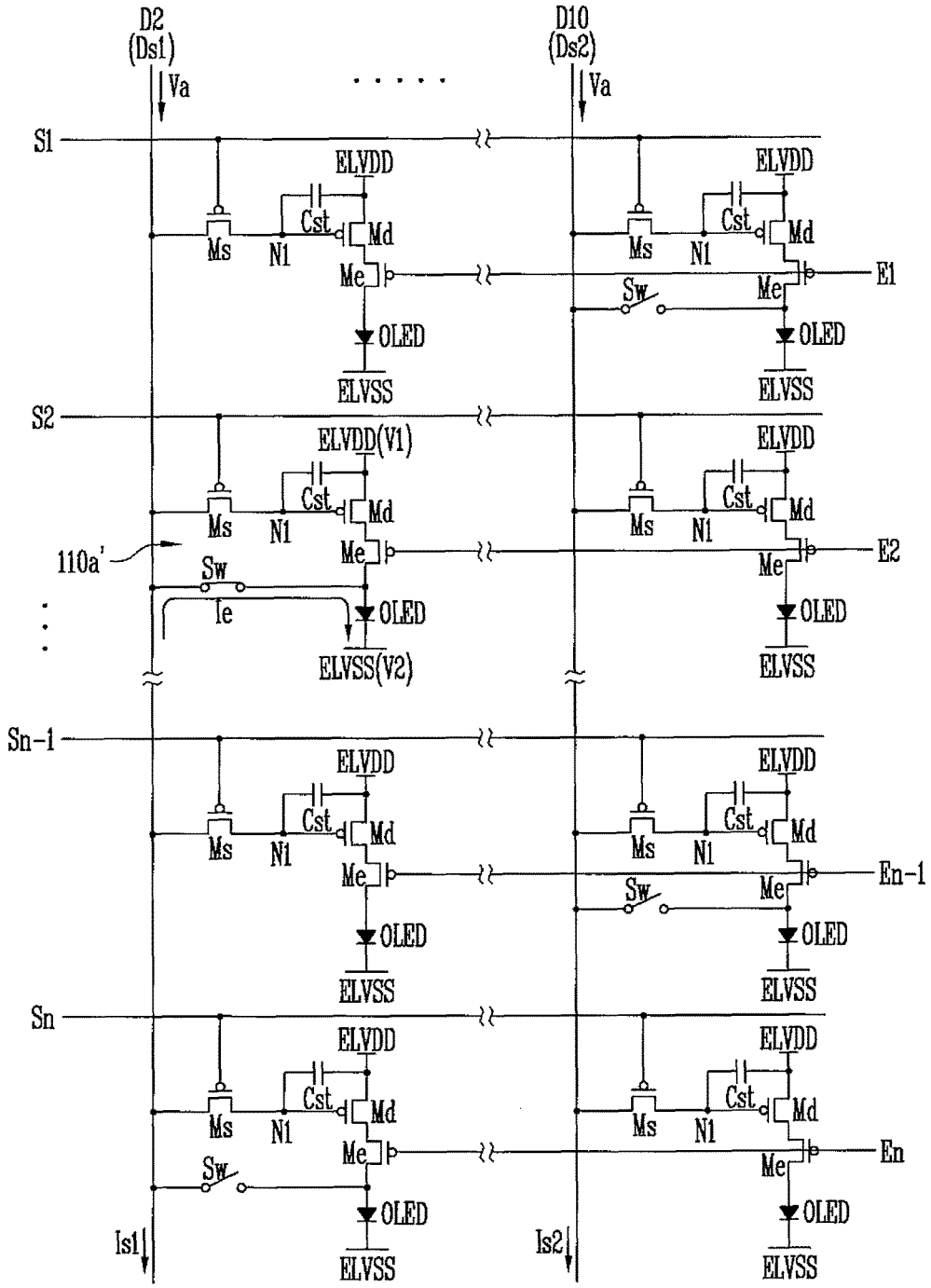

FIGS. 10 and 11 are diagrams illustrating a current sensing operation according to an embodiment of an organic light emitting display device shown in FIG. 8. A case in which the second data line D2 and the tenth data line D10 are selected by the multiplexer 200 during the current sensing period Ps is described with reference to FIGS. 10 and 11.

Therefore, the second data line D2 and the tenth data line D10 selected by the multiplexer 200 may be electrically connected to the first terminal T1 and the second terminal T2 of the current sensing circuit 10, respectively.

For convenience of explanation, the data line D2 coupled to the first terminal T1 of the current sensing circuit 10 may be referred to as the first sensing data line Ds1.

In addition, the data line D10 coupled to the second terminal T2 of the current sensing circuit 10 may be referred to as the second sensing data line Ds2.

At least one of the sensing switches Sw coupled to the first sensing data line Ds1 may be turned on.

For example, to detect a degree of deterioration of the pixel (e.g., the predetermined pixel) 110*a*' coupled to the second scan lines S2, the second data line D2 and the second control line En, the sensing switch Sw included in the pixel (e.g., the predetermined pixel) 110*a*' may be turned on.

The degree of deterioration of the pixel (e.g., the predetermined pixel) 110*a*' may be detected by sensing the current Ie flowing through the organic light emitting diode OLED.

The first driving voltage ELVDD may be set to the first voltage V1 having the positive polarity, and the second driving voltage ELVSS may be set to the second voltage V2 having the negative polarity.

In addition, to block the current which is supplied from the driving transistor Md, the control transistor Me may remain turned off.

For example, the control line driver 140 may not supply an emission control signal to all the pixels 110' during the current sensing period Ps.

The auxiliary voltage Va may be supplied to the first sensing data line Ds1. The auxiliary voltage Va may be set to a value between the first voltage V1 and the second voltage V2.

Therefore, an amount of (e.g., a predetermined amount of) the current Ie may flow to the organic light emitting diode OLED included in the pixel (e.g., the predetermined pixel) 110*a*' from the first sensing data line Ds1 through the sensing switch Sw.

The first sensing current Is1 flowing from the first sensing data line Ds1 to the first terminal T1 of the current sensing circuit 10 may be expressed as follows:

$$Is1=-Ie.$$

To sense a leakage current of the second sensing data line Ds2, all the sensing switches Sw coupled to the second sensing data line Ds2 may be turned off.

In addition, the same auxiliary voltage Va as that applied to the first sensing data line Ds1 may be supplied to the second sensing data line Ds2.

Although all the sensing switches Sw coupled to the second sensing data line Ds2 are turned off, a leakage current may still flow. Thus, the second sensing current Is2 (e.g., the predetermined second sensing current Is2) may flow from the second sensing data line Ds2 to the second terminal T2 of the current sensing circuit 10.

Therefore, the above-described current sensing circuit 10 may receive the first sensing current Is1 and the second sensing current Is2.

Subsequently, the current sensing circuit 10 may generate the final output signal Vm by using the first sensing current Is1 and the second sensing current Is2, and supply the generated output signal Vm to the timing controller 170.

A case in which each of the pixels includes the sensing switch Sw is described above with reference to FIG. 10. However, the present invention is not limited thereto.

In other words, as shown in FIG. 11, some of the sensing switches Sw shown in FIG. 10 may be omitted.

Figure 12:
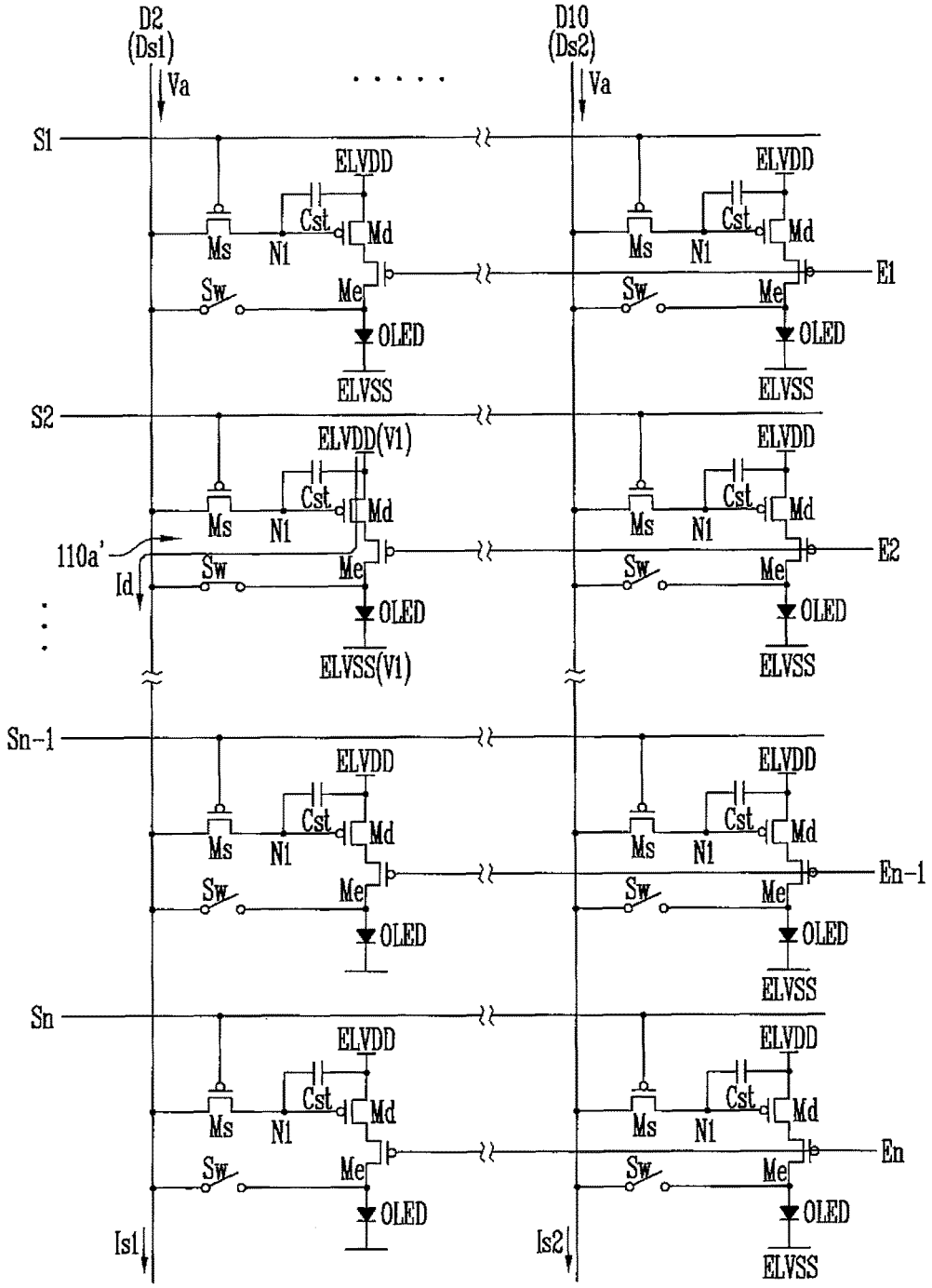
FIGS. 12-13 are diagrams illustrating an organic light emitting display device shown in FIG. 8.
Figure 13:
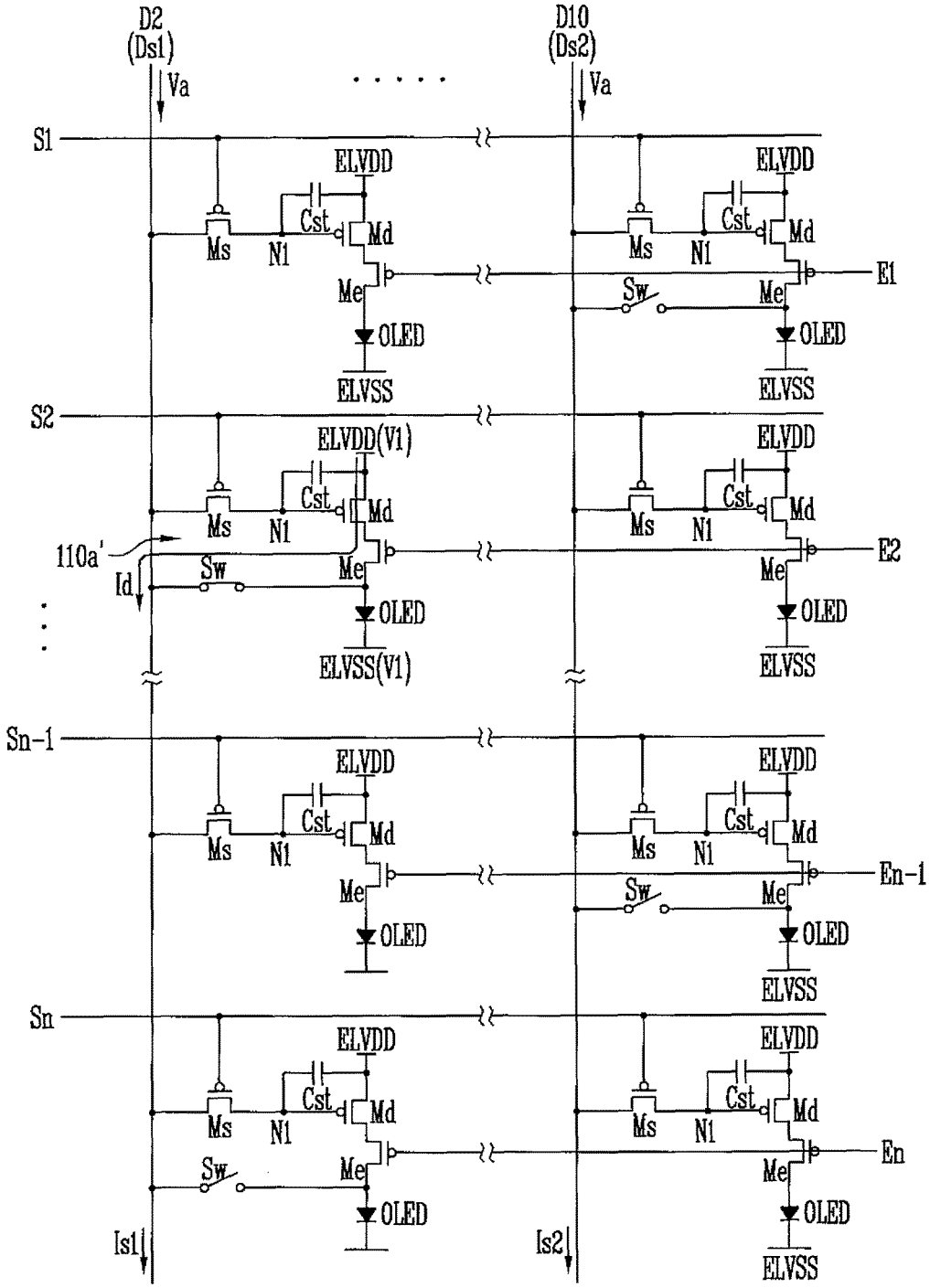

FIGS. 12 and 13 are diagrams illustrating a current sensing operation according to another embodiment of an organic light emitting display device shown in FIG. 8. A case in which the second data line D2 and the tenth data line D10 are selected by the multiplexer 200 during the current sensing period Ps is described below with reference to FIGS. 12 and 13.

Therefore, the second data line D2 and the tenth data line D10 selected by the multiplexer 200 may be electrically connected to the first terminal T1 and the second terminal T2 of the current sensing circuit 10, respectively.

For convenience of explanation, the data line D2 coupled to the first terminal T1 of the current sensing circuit 10 may be referred to as the first sensing data line Ds1.

In addition, the data line D10 coupled to the second terminal T2 of the current sensing circuit 10 may be referred to as the second sensing data line Ds2.

At least one of the sensing switches Sw coupled to the first sensing data line Ds1 may be turned on.

For example, to detect a degree of deterioration of the pixel (e.g., the predetermined pixel) 110*a*' coupled to the second scan lines S2 and the second data line D2, the sensing switch Sw included in the pixel (e.g., the predetermined pixel) 110*a*' may be turned on.

By sensing the amount of the current Id (e.g., the predetermined amount of the current Id) flowing through the driving transistor Md, the degree of deterioration of the pixel (e.g., the predetermined pixel) 110*a*' may be detected.

Both the first driving voltage ELVDD and the second driving voltage ELVSS may be set to the first voltage V1 having the positive polarity.

In addition, to transfer the amount of the current Id (e.g., the predetermined amount of the current Id) supplied from the driving transistor Md to the first sensing data line Ds1, the control transistor Me may remain turned on.

For example, the control line driver 140 may supply the emission control signal to a control line E2 coupled to the pixel (e.g., the predetermined pixel) 110*a*' during the current sensing period Ps.

In addition, the auxiliary voltage Va may be supplied to the first sensing data line Ds1. The auxiliary voltage Va may be set to a value between the first voltage V1 and the second voltage V2.

Therefore, the amount of the current Id1 (e.g., the predetermined amount of the current Id1) may flow to the first sensing data line Ds through the driving transistor Md, the control transistor Me and the sensing switch Sw included in the pixel (e.g., predetermined pixel) 110*a'*.

The first sensing current Is1 flowing from the first sensing data line Ds1 to the first terminal T1 of the current sensing circuit 10 may be expressed as follows:

$$Is1=Id.$$

To sense a leakage current of the second sensing data line Ds2, all the sensing switches Sw coupled to the second sensing data line Ds2 may be turned off.

In addition, the same auxiliary voltage Va as that applied to the first sensing data line Ds1 may be supplied to the second sensing data line Ds2.

Although all the sensing switches Sw coupled to the second sensing data line Ds2 are turned off, a leakage current may still flow. Therefore, the second sensing current Is2 (e.g., the predetermined second sensing current Is2) may flow from the second sensing data line Ds2 to the second terminal T2 of the current sensing circuit 10.

Therefore, the above-described current sensing circuit 10 may receive the first sensing current Is1 and the second sensing current Is2.

Subsequently, the current sensing circuit 10 may generate the final output signal Vm by using the first sensing current Is1 and the second sensing current Is2, and supply the generated output signal Vm to the timing controller 170.

A case in which each of the pixels includes the sensing switch Sw is described above with reference to FIG. 12. However, the present invention is not limited thereto.

In other words, in as shown FIG. 13, some of the sensing switches Sw shown in FIG. 12 may be omitted.

By way of summation and review, when used for a long period of time, an organic light emitting display device may not display an image with a desired brightness because pixels may be deteriorated.

To reduce or prevent the deterioration of the pixel, a current sensing circuit for measuring a degree of deterioration of the pixel may be provided, and a method of compensating for the deterioration of the pixel by the current sensing circuit may be used.

However, when an excessive input current flows, an integrator included in the comparable (e.g., related art) current sensing circuit may not accurately sense the current.

According to an embodiment of the present invention, a current sensing circuit may reduce or prevent saturation of an integrator even when an excessive input current is input, so that a current may be accurately sensed.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent to" another element or layer, it can be directly on, connected to, coupled to, or adjacent to the other element or layer, or one or more intervening elements or layers may be present. When an element or layer is referred to as being "directly on," "directly connected to", "directly coupled to", or "immediately adjacent to" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all subranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112, first paragraph, and 35 U.S.C. § 132(a).

The current sensing circuit and the organic light emitting display device and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the current sensing circuit and/or the organic light emitting display device may be formed on one integrated circuit (IC) chip or on separate IC chips. Further, the various components of the current sensing circuit may be implemented on a flexible printed circuit film, a tape carrier package (TCP), a printed circuit board (PCB), or formed on a same substrate. Further, the various components of the current sensing circuit and/or the organic light emitting display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various suitable changes in form and details may be made without departing from the spirit and scope of the present invention as set forth in the following claims, and equivalents thereof.

What is claimed is:

1. A current sensing circuit, comprising:

a first integrator coupled to a first terminal of the current sensing circuit and configured to receive a first input current and to output a first integration signal;

a second integrator coupled to a second terminal of the current sensing circuit and configured to receive a second input current and to output a second integration signal, the first and second integrators being configured to concurrently receive respective ones of the first and second input currents;

a first variable current source coupled to an input terminal of the first integrator;

a second variable current source coupled to an input terminal of the second integrator; and a current controller configured to control the first input current and the second input current by adjusting both an output current of the first variable current source coupled to the first integrator and an output current of the second variable current source coupled to the second integrator based on the second integration signal.

2. The current sensing circuit as claimed in claim 1, further comprising an output unit configured to receive the first integration signal and the second integration signal, and to output a signal corresponding to a difference between the first integration signal and the second integration signal.

3. The current sensing circuit as claimed in claim 1, wherein the output current of the first variable current source and the output current of the second variable current source are substantially the same.

4. The current sensing circuit as claimed in claim 1, wherein the current controller is further configured to compare a value of the second integration signal with a reference value, and to increase the output current of the first variable current source and the output current of the second variable current source when the value of the second integration signal is greater than the reference value.

5. The current sensing circuit as claimed in claim 1, wherein the first input current decreases as the output current of the first variable current source increases, and wherein the second input current decreases as the output current of the second variable current source increases.

6. An organic light emitting display device, comprising:

a plurality of pixels coupled to a plurality of scan lines and a plurality of data lines; and a current sensing circuit configured to receive a first sensing current and a second sensing current output from two of the data lines, wherein the current sensing circuit comprises:

a first terminal configured to receive the first sensing current;

a second terminal configured to receive the second sensing current;

a first integrator having an input terminal coupled to the first terminal, the first integrator being configured to receive a first input current and to output a first integration signal;

a second integrator having an input terminal coupled to the second terminal, the second integrator being configured to receive a second input current and to output a second integration signal, the first and second integrators being configured to concurrently receive respective ones of the first and second input currents;

a first variable current source coupled to the input terminal of the first integrator;

a second variable current source coupled to the input terminal of the second integrator; and a current controller configured to control the first input current and the second input current by adjusting both an output current of the first variable current source coupled to the first integrator and an output current of the second variable current source coupled to the second integrator based on the second integration signal.

7. The organic light emitting display device as claimed in claim 6, wherein the current sensing circuit further comprises an output unit configured to receive the first integration signal and the second integration signal, and to output a signal corresponding to a difference between the first integration signal and the second integration signal.

8. The organic light emitting display device as claimed in claim 6, wherein the output current of the first variable current source and the output current of the second variable current source are substantially the same.

9. The organic light emitting display device as claimed in claim 6, wherein the current controller is further configured to compare a value of the second integration signal with a reference value, and to increase the output current of the first variable current source and the output current of the second variable current source when the value of the second integration signal is greater than the reference value.

10. The organic light emitting display device as claimed in claim 6, wherein the first input current decreases as the output current of the first variable current source increases, and wherein the second input current decreases as the output current of the second variable current source increases.

11. The organic light emitting display device as claimed in claim 6, further comprising a multiplexer coupled to the data lines, wherein the multiplexer is configured to select the two of the data lines and to electrically connect the two of the data lines to the first terminal and the second terminal, respectively.

12. The organic light emitting display device as claimed in claim 11, wherein each of the pixels comprises:

an organic light emitting diode;

a pixel circuit between a scan line of the plurality of scan lines, a data line of the plurality of data lines, and an anode electrode of the organic light emitting diode, and configured to control a current supplied to the organic light emitting diode; and a sensing switch coupled between the anode electrode of the organic light emitting diode and the data line.

13. The organic light emitting display device as claimed in claim 12, wherein each pixel circuit comprises:

a driving transistor coupled between a driving voltage supply and the anode electrode of the organic light emitting diode and having a gate electrode coupled to a first node;

a scan transistor coupled between the respective data line in the pixel circuit and the first node and having a gate electrode coupled to the scan line; and a storage capacitor coupled between the driving voltage supply and the first node.

14. The organic light emitting display device as claimed in claim 13, wherein the pixel circuit further comprises a control transistor coupled between the driving transistor and the organic light emitting diode.

15. The organic light emitting display device as claimed in claim 12, wherein the plurality of data lines comprise a first sensing data line electrically coupled to the first terminal of the current sensing circuit and a second sensing data line electrically coupled to the second terminal of the current sensing circuit by the multiplexer, wherein at least one of sensing switches including the sensing switch coupled to the first sensing data line is turned on, and wherein all the sensing switches coupled to the second sensing data line are turned off.

* * * * *